United States Patent [19]

Storey

[11] Patent Number: 4,630,730

[45] Date of Patent: Dec. 23, 1986

[54] KNITTING PROJECT WORKBOX

[76] Inventor: Patricia J. Storey, 1502 E. Mission, Escondido, Calif. 92025

[21] Appl. No.: 846,155

[22] Filed: Mar. 31, 1986

[51] Int. Cl.[4] ..... B65D 85/66

[52] U.S. Cl. ..... 206/392; 206/388; 206/391

[58] Field of Search ..... 206/442, 388, 391, 392, 206/83.5; 209/122; 242/55.3

[56] References Cited

U.S. PATENT DOCUMENTS

| | | | |
|---|---|---|---|
| 334,704 | 1/1886 | Hoyle | 206/388 |
| 2,181,808 | 11/1939 | Goldsmith | 206/391 |
| 2,214,380 | 9/1940 | Nisbet | 206/391 |
| 4,008,806 | 2/1977 | de Paez et al. | 206/388 |
| 4,348,439 | 9/1982 | Jones | 206/388 |

*Primary Examiner*—Joseph Man-Fu Moy
*Attorney, Agent, or Firm*—John J. Murphey

[57] ABSTRACT

A workbox for a knitting project containing a plurality of small containers connected together, to house the individual yarns, each container having a loading door and a top aperture that is staggered with its neighbor apertures, from which the yarn issues for use in the project, a swivel supporting the box to allow it to be easily rotated to keep in phase with the knitter, a cover for placement over the box having a top higher than the containers so that partially finished projects may be stored therebetween, and a handle by which the box is carried from place to place.

7 Claims, 3 Drawing Figures

KNITTING PROJECT WORKBOX

BACKGROUND OF THE INVENTION

1. Field of the Invention

This invention pertains to the field of handicrafts. More particularly, this invention pertains to the field of yarn knitting, especially large, complex knitting projects such as afghans and to a combination transport and containment workbox therefor.

2. Description of the Prior Art

Yarn knitting has been a popular handicraft since the dawn of our nation. While it is now common for knit goods to be machine knitted, the traditional hand-knitting project is central to many societies, urban as well as rural. Generally speaking, one begins their training in knitting with a simple one or two color project. With practice comes knowledge and the ability to proceed to more complex projects. The ultimate in complexity for handicraft knit projects is the traditional afghan, a large blanket or shawl knit of numerous colored yarns in a variegated pattern such as plaid, argyle and the like.

Some of these large projects are assembled from individually knitted subunits, however, traditionally, the afghan or blanket knit project is a unitary structure. An afghan incorporates many colors, each color being a separate yarn. A row, the width of the project, is knitted and, as each colored yarn is needed, it is brought into the row, usually from below the knitter who is sitting in a chair. After the row is completed, the knitter turns the whole project 180° so that the previously outside facing side of the afghan is now turned to face the knitter. The separate incoming colored yarns must also be rotated 180° to prevent entanglement which results in kinks and knots in the yarns.

In addition to the need to prevent the different yarns from entangling, there is also the problem of protecting the yarns before their incorporation and further to transport the yarns and the partially completed knit project from place to place without damage. Yarns have a propensity to pick up lint and dirt. Once incorporated into the knitting, these undesirables are difficult to wash away or otherwise remove. Further, the large knit blanket tends to catch and snag on door frames, chairs and other wooden structures. Furthermore, transporting yarns in a bag or similar container is unwieldy and can result in one huge mess if it is dropped, causing much frustration and dissatisfaction to the knitter.

SUMMARY OF THE INVENTION

This invention overcomes all of the problems heretofore mentioned in this particular field of art. There is provided by virtue of this invention a unitary structure comprising separate containers in which different colored yarns may be stored, apertures in each container through which each yarn is withdrawn for incorporation into the project, a swivel supporting the structure on the floor, below the hands of the knitter, such that, when the knitter rotates the work through 180°, they may easily rotate the structure 180° to keep the yarns in phase, a separate storage compartment for needles and other hard objects that, if stored together with the work in progress, could entangle therein and a storage compartment above the yarn source for storage of the partially completed knitting project directly adjacent the yarn source to reduce the distance between the stored yarn and the project. These different elements are placed in geometric relationship to facilitate all aspects of the knitting project.

For instance, the small containers for the source yarns are arranged on a common plane so that tension on each yarn strand is identical resulting in a consistent stress pattern of the knitted material in the project. Further, each yarn source container has a separate loading door as well as a separate aperture to isolate the yarn and prevent its entanglement with other yarns prior to incorporation in the project. The swivel stand supporting the workbox allows the knitter to rotate the workbox with their foot while in a sitting position thereby eliminating the need to stand and rotate the work or change chairs that normally result in entangling the yarn. Finally, the cover over the containers forms a storage compartment atop the apertures so that the stored knitting is directly adjacent thereto for reducing the length of unused yarn between the source container and the project so as to reduce the possibility of entanglement.

Accordingly, the main object of this invention is to provide a workbox from which a knitting project may be constructed and in which the partially completed project may be stored and transported. Other objects of this invention include a means of isolating separately required yarns from dirt, lint and opportunity for snagging during the fabrication phase of the project, a workbox from which individual yarns may be withdrawn for incorporation into the project and may be manipulated to maintain a direct phase relationship with the project as it is being completed, and a workbox in which all parts of the project may be stored and transported in an easily accessible manner. These and other objects of the invention will become more clear upon a reading of the description of the preferred embodiment, taken along with the drawings that are appended hereto. The proprietary matter to which the inventor lays claim for her monopoly authorized under Article 1, Section 8 of the United States Constitution may be gleaned from a fair reading of the claims that conclude this specification.

DESCRIPTION OF THE PREFERRED EMBODIMENT

Figure 1:
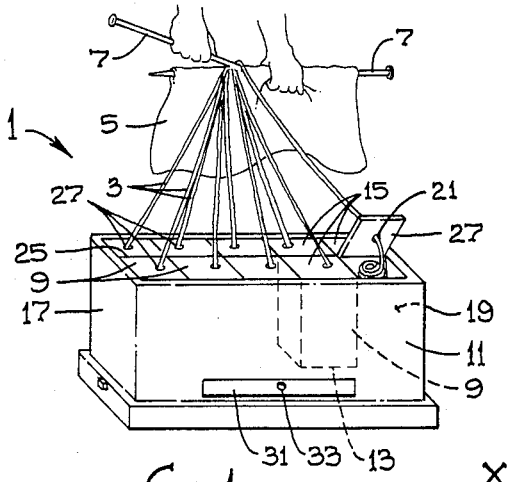
FIG. 1 is an oblique view of one embodiment of this invention showing yarn being extracted therefrom and directly incorporated into a knitting project.

FIG. 1 shows the lower portion of the workbox, generally shown at 1, being used to supply strands of different colored yarn 3, upward to a knitting project 5, such as an afghan, that is being prepared on a pair of knitting needles 7 that are manipulated by hand. Lower portion 1 comprises a plurality of fully enclosed small containers 9, shown in dotted outline in FIGS. 1 and 3, each comprising fully enclosed sidewalls 11 terminated by a bottom 13 and a top 15. Said containers may be constructed of virtually any material, cardboard or any other pressed fiber board as well as plastic sheeting have been found to be convenient. Containers 9 are assembled together in tangential geometry so that their tops 15 lie along a common plane shown generally at x-y. For convenience in passing the workbox through a doorway or other narrow structure, it has been found convenient to arrange containers 9 in pairs to form a rectangular or otherwise elongated box. Assembled containers 9 are enclosed by mutual pairs of opposed side walls 17 and 19 to form the outer perimeter of workbox lower portion 1.

Figure 2:
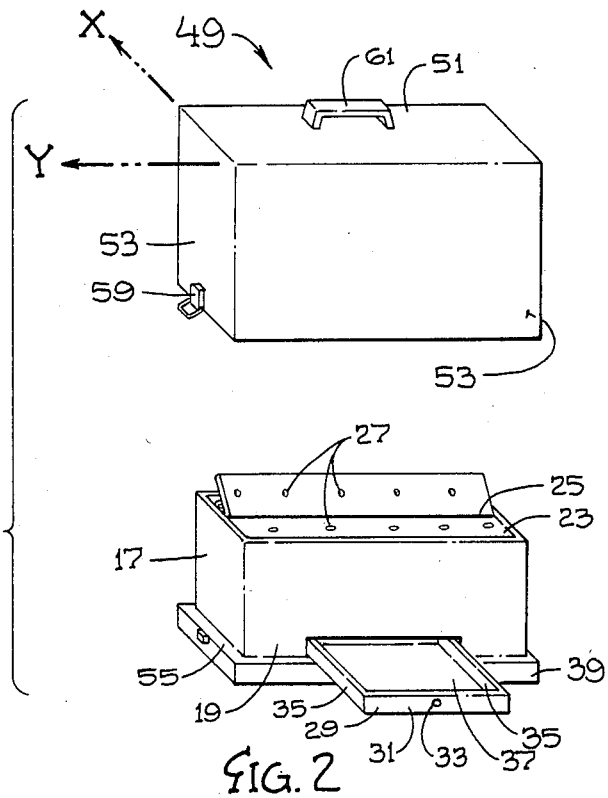
FIG. 2 is an oblique view of another embodiment showing the loading doors into the box to be joined together and hinged at the middle.

Containers 9 each have a loading door 21, conveniently placed at the top thereof in plane x-y for use in loading and unloading yarn therein. As shown in FIG. 2, loading doors 21 may be joined together along the top of each row of containers 9 to form a common loading door 23 covering the full row. Doors 21 and 23 are hinged to one side, and preferrably along the central sidewall of the assembled containers, shown at 25, to prevent them from falling away from the workbox. An aperture 27 is positioned atop each container 9 and arranged in a staggered pattern so that, from the side of workbox 1, each aperture lies between its neighbor fore and aft, so that each strand of yarn 3 may be directed from storage within container 9 to knitting project 5 free from entanglement with a neighbor strand. It has been found convenient to place aperture 27 in loading door 21 or common loading door 23 for ease in operation.

Below container bottom 13 is provided a slide-out type drawer 29 having a front wall 31, adapted when closed to be flush with side wall 19, and to which is attached a handle 33 and a pair of side walls 35 extending upward from the edges of a drawer bottom 37. Drawer 29 is used to store unused knitting needles, scissors, knitting diagrams and the like. A bottom wall 39 extends across underneath workbox lower portion 1, below drawer 29 coextensive with sides 17 and 19 to provide support thereto.

A swivel stand, shown generally at 41, supports workbox lower portion 1 on a floor or other resting surface. Said stand 41 comprises a base 43 on which is mounted a turntable 45 that is attached to bottom 39 by a mounting plate 47. The knitter may rotate workbox lower portion 1 by merely tapping one end thereof with his or her foot to keep yarns 3 in phase with knitting project 5 as it is turned in the hands of the knitter.

Figure 3:
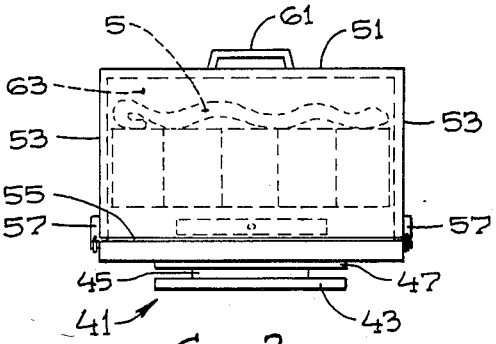
FIG. 3 is a side elevational view of the embodiment shown in FIGS. 1 and 2 with the top cover in its fully closed position and further showing, in phantom outline, how a partially completed knitting project is stored between the cover and the yarn source containers.

As shown in FIG. 2, a cover 49 is provided for placement over lower portion 1 during transport and storage of knitting project 5. Cover 49 comprises a top cover plate 51 of a size and shape to extend across the length and breadth of assembled containers 9 and overlap them slightly. Depending from around the perimeter of cover plate 51 are enclosed side walls 53 that extend downward to meet an abutment lip 55 formed along the lower portion of side walls 17 and 19. A pair of fasteners 57 are provided at opposite sides of workbox lower portion 1 adjacent abutment lip 55 for interconnection with a pair of catches 59 formed on the outside of side walls 53 and adjacent thereto when cover 49 is slipped over workbox lower portion 1. A handle 61 is positioned atop cover plate 51 for ease in transporting the assembled workbox from place to place. Cover side walls 53 are higher than the distance from abutment lip 55 to container top 15 so as to provide, when assembled, a storage space 63 atop containers 9. As shown in FIG. 3, knitting project 5 may be stored therein when cover 49 is placed over workbox lower portion 1. This allows the length of yarn strands 3 to be minimized outside containers 9 to reduce the possibility of kinking and knotting of yarn strands 3 during storage and transportation of knitting project 5.

What is claimed is:

1. A workbox for a knitting project, comprising:

(a) a plurality of fully enclosed small containers, in which to store different yarns needed as source yarns in the project, said containers assembled in tangential geometry so that their tops lie in a common plane;

(b) each said container having a hinged loading door and an aperture through which a strand of yarn may pass from storage to the knitting project for incorporation therein;

(c) a swivel stand supporting said assembled containers to permit rotation thereof in phase with rotation by the knitter of the knitting project;

(d) a cover for placement over said containers comprising a top plate spaced above said containers, creating a space therebetween for storage of the knitting project therein, enclosing sides depending from said plate around the outside of said storage boxes to encase said knit project storage area and containers therein, means for temporarily fastening said cover to said assembled containers; and, (e) a handle atop said cover for transporting said workbox.

2. The workbox of claim 1 wherein said small containers are rectangular in shape.

3. The workbox of claim 1 wherein said containers and said cover form a rectangular workbox.

4. The workbox of claim 1 wherein said appertures are formed in said loading doors.

5. The workbox of claim 4 wherein said loading doors are joined to form a common loading door for a row of assembled containers.

6. The workbox of claim 1 further including a storage drawer below said containers for storage of knitting utensils.

7. The workbox of claim 1 wherein said apertures lie in a staggered pattern to prevent entanglement of yarn strands as they are withdrawn therethrough from the side of said workbox during a knitting project.

* * * * *